US006619624B2

(12) United States Patent
Lamphen

(10) Patent No.: US 6,619,624 B2
(45) Date of Patent: Sep. 16, 2003

(54) HOISTING MECHANISM

(75) Inventor: Nicolaas Lamphen, Vianen (NL)

(73) Assignee: Mammoet Holding G.V., Schiedam (NL)

( * ) Notice: Subject to any disclaimer, the term of this patent is extended or adjusted under 35 U.S.C. 154(b) by 0 days.

(21) Appl. No.: 10/194,753

(22) Filed: Jul. 10, 2002

(65) Prior Publication Data

US 2003/0030046 A1 Feb. 13, 2003

(30) Foreign Application Priority Data

Jul. 13, 2001 (NL) ..... 1018535

(51) Int. Cl.[7] ..... B66D 1/00

(52) U.S. Cl. ..... 254/266; 254/388; 254/389; 242/615.4; 242/397.1

(58) Field of Search ..... 254/266, 272, 254/382, 388, 389; 242/615, 615.4, 397.1, 397, 157 R

(56) References Cited

U.S. PATENT DOCUMENTS

| | | | | | |
|---|---|---|---|---|---|
| 420,509 | A | | 2/1890 | Griswold | |
| 1,744,616 | A | * | 1/1930 | Cunningham | 242/444.2 |
| 2,387,520 | A | * | 10/1945 | Lindabury | 254/389 |
| 2,417,706 | A | * | 3/1947 | Scarborough | 254/389 |
| 2,418,105 | A | * | 3/1947 | Wohler | 254/389 |
| 3,052,425 | A | | 9/1962 | Reed et al. | |
| 3,135,468 | A | | 6/1964 | Harlander | |
| 3,886,888 | A | | 6/1975 | Parsons | |
| 4,468,006 | A | * | 8/1984 | Frommherz | 254/389 |
| 6,092,756 | A | * | 7/2000 | Sola | 242/399.2 |
| 6,267,355 | B1 | * | 7/2001 | Fletcher | 254/134.3 R |
| 6,416,010 | B2 | * | 7/2002 | Fletcher | 242/397 |
| 6,516,892 | B2 | * | 2/2003 | Reilly | 166/384 |

FOREIGN PATENT DOCUMENTS

| | | |
|---|---|---|
| EP | 0 990 618 A | 4/2000 |
| FR | 2525259 A | 4/1983 |
| FR | 2625737 A | 7/1989 |
| GB | 291855 A | 6/1928 |

* cited by examiner

*Primary Examiner*—Emmanuel Marcelo
(74) *Attorney, Agent, or Firm*—Jeffrey D. Myers

(57) ABSTRACT

The invention relates to a hoisting mechanism comprising a rotatable reel and hoisting cables to be wound onto the reel, the hoisting cables running substantially parallel to one another, and a guide plate having feed-through apertures for the hoisting cables, with at most one hoisting cable running through each feed-through aperture. For each hoisting cable a guide member is provided between the rotatable reel and the guide plate, which guide member is embodied as a spiral spring whose coils abut to one another and whose inside diameter is dimensioned such that the hoisting cable fed through the spiral spring is able to move in the feed direction.

4 Claims, 1 Drawing Sheet

HOISTING MECHANISM

Figure 2:
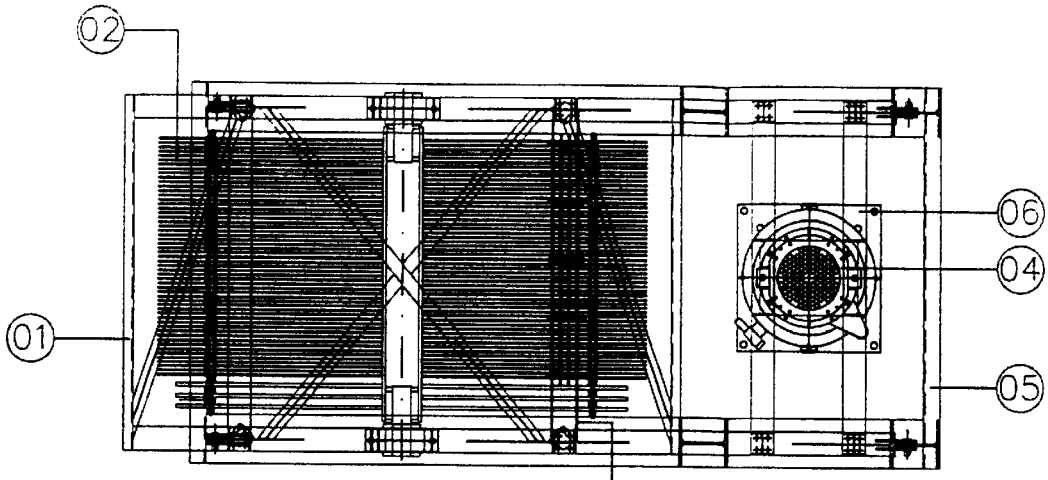

The invention relates to a hoisting mechanism comprising a rotatable reel and hoisting cables to be wound onto the reel, the hoisting cables running substantially parallel to one another, and a guide plate having feed-through apertures for the hoisting cables, with at most one hoisting cable running through each feed-through aperture.

Such a hoisting mechanism is known from practice and is used for hoisting heavy loads. These loads are so heavy that it is necessary to use several parallel running hoisting cables. In practice the number of parallel running hoisting cables may be approximately 50. These hoisting cables are fed through the guide plate after which they converge in a so-called "strand jack" to which the load to be hoisted is coupled.

A problem of this known hoisting mechanism is that it is not possible or hardly possible to unwind the hoisting cables from the reel. One of the reasons is that the hoisting cables tangle up. Furthermore, the hoisting cables are not suitable for compressive strain. In practice this means that the known hoisting mechanism only allows the hoisting cables to be wound onto the reel and after the hoisting mechanism has been used in this manner for hoisting a load, the wound up hoisting cables are turned into scrap.

The problem of the known hoisting mechanism not allowing the unwinding of the reel leads to yet another problem, which occurs if the known hoisting mechanism is being used at several places for hoisting a particularly heavy load. In that case it may be necessary to reposition the load to be hoisted, for which purpose one or more of the hoisting mechanisms may have to undergo an adjustment in height. For reasons explained above, this is not possible with the known hoisting mechanism, so that such exceptionally heavy loads cannot be hoisted with the known hoisting mechanism.

It is the object of the invention to remove the above-mentioned problems and to achieve further advantages, which will be explained below.

The hoisting mechanism according to the invention is thus characterized in that for each hoisting cable a guide member is provided between the rotatable reel and the guide plate, which guide member is embodied as a spiral spring whose coils abut to one another and whose inside diameter is dimensioned such that the hoisting cable fed through the spiral spring is able to move in the feed direction.

Surprisingly it has been shown that the problems of the known hoisting mechanism are solved by using spiral springs for guiding the hoisting cables. This is all the more surprising since a perhaps obvious solution in the form of a tube does not solve the problems. It is therefore essential for the invention that the guide member takes the form of a spiral spring.

Desirably, the coils of the spiral spring abut so closely that when the hoisting cables come under stress, the mutual contact between said coils is maintained.

Because the guide member is embodied as spiral spring, even a tightly-wound one as just now mentioned, it is able to allow the spiral springs to assume a position such that when the hoisting cables are under "heavy" strain, the forces over the individual hoisting cables are distributed optimally.

It is further desirable for the inside diameter of the spiral spring to be dimensioned such that some lateral movement of the hoisting cable in the spiral spring is possible. For example, if the hoisting cables have an outside diameter of 18 mm, an inside diameter of 23 mm will suffice very well for the spiral spring, especially with a view to allowing enough free space for movement in the portion of the spiral spring where it bends.

It is further advantageous for a comb member to be provided near the reel for the individual guidance of each hoisting cable from the reel to the guide member of that hoisting cable. This effectively aids in preventing the hoisting cables from tangling up.

The invention will be further explained below with reference to a non-limiting exemplary embodiment of a hoisting mechanism according to the invention and with reference to the accompanying drawing.

Figure 1:
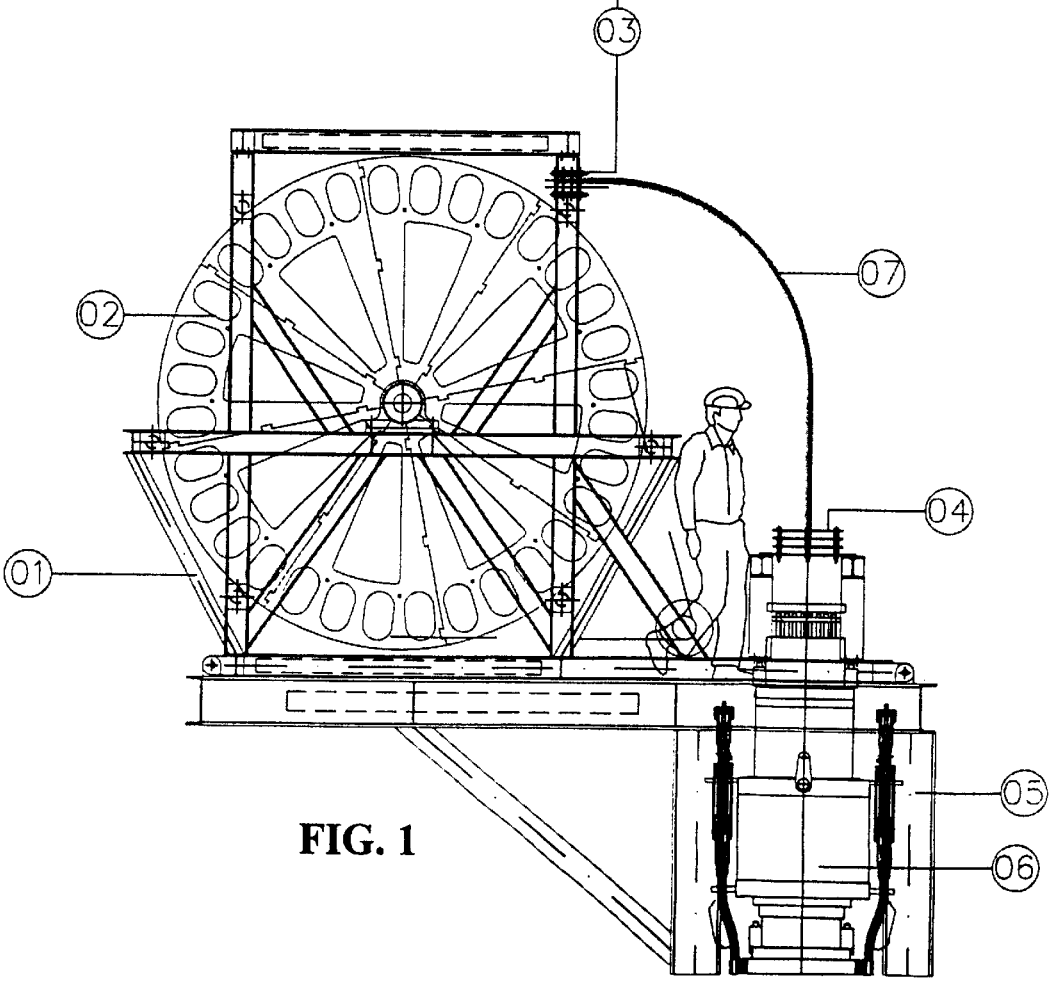

The drawing shows in:

FIG. 1 a side view of the hoisting mechanism according to the invention; and in FIG. 2 a top view of the hoisting mechanism according to FIG. 1.

Identical reference numbers in the figures refer to similar parts.

The hoisting mechanism 1 shown in FIGS. 1 and 2 comprises a rotatable reel 2 for the hoisting cables to be wound onto and off the reel. So as not to spoil the clarity of the drawing, the hoisting cables are not shown in the figures. The hoisting cables substantially run parallel to one another and through a guide plate that is equipped with feed-through apertures for the hoisting cables. At most one hoisting cable passes through each feed-through aperture. In practice, approximately 50 hoisting cables are thus being fed through the feed-through plate 4. In practice, the rotatable reel 2 and the feed-through plate 4 for the hoisting cables are placed on a platform 5 below which a so-called strand jack 6 is suspended. At the top side of this strand jack 6 the hoisting cables converge. At the lower side of the strand jack 6 the load to be hoisted can be fastened.

For the sake of clarity, FIG. 1 only shows one guide member 7 for the feed-through of a hoisting cable. This guide member 7 extends between the rotatable reel 2 and the guide plate 4, and is embodied as a spiral spring whose coils abut to one another so as to form a substantially closed guide tube for the hoisting cable. The inside diameter of the spiral spring is dimensioned such that the hoisting cable being fed through the spiral spring 7 can be moved relatively effortlessly in the feed-through direction. The coils of the spiral spring 7 are wound so tightly together that when the hoisting cables come under stress, the mutual contact between the coils is maintained. The inside diameter of the spiral spring 7 is further dimensioned such that some lateral movement of the hoisting cable in the spiral spring 7 is possible. In practice, if the hoisting cables have an outside diameter of 18 mm, an inside diameter of 23 mm will suffice for the spiral spring.

The spiral spring 7 is not shown in FIG. 2, but to the person skilled in the art it will be obvious that the number of spiral springs 7 arranged between the reel 2 and the guide plate 4 is equal to the number of hoisting cables running from the reel 2 to the guide plate 4.

To enable the mechanism to function properly it is further desirable—as shown in FIG. 2—for a comb member 8 to be used for the individual guidance of each hoisting cable from the reel 2 to the respective hoisting cable's spiral spring 7.

The invention as elucidated in the above non-limiting specification of an exemplary embodiment is not limited to this specific example. The protective scope this invention is entitled to is solely limited by the appended claims.

What is claimed is:

1. A hoisting mechanism comprising a rotatable reel and hoisting cables to be wound onto the reel, the hoisting cables running substantially parallel to one another, and a guide plate having feed-through apertures for the hoisting cables, with at most one hoisting cable running through each feed-through aperture, wherein for each hoisting cable a guide member is provided between the rotatable reel and the guide plate, which guide member is embodied as a spiral spring whose coils abut to one another and whose inside diameter is dimensioned such that the hoisting cable fed through the spiral spring is able to move in a feed direction.

2. A hoisting mechanism according to claim 1, wherein the coils of the spiral spring abut so closely that when the hoisting cables come under stress, mutual contact between said coils is maintained.

3. A hoisting mechanism according to claim 1 wherein the inside diameter of the spiral spring is dimensioned such that some lateral movement of the hoisting cable in the spiral spring is possible.

4. A hoisting mechanism according to claim 1, wherein a comb member is provided near the reel for the individual guidance of each hoisting cable from the reel to the guide member of that hoisting cable.

* * * * *